United States Patent [19]

Blout

[11] 4,342,267

[45] Aug. 3, 1982

[54] HOPPER DISCHARGE UNIT WITH SLIDING GATE

[75] Inventor: Bennett O. Blout, Berwyn, Ill.

[73] Assignee: Evans Products Company, Portland, Oreg.

[21] Appl. No.: 177,816

[22] Filed: Aug. 13, 1980

[51] Int. Cl.[3] ..... B61D 7/20; B61D 7/22; B61D 7/26

[52] U.S. Cl. ..... 105/282 P; 105/282 A; 105/304

[58] Field of Search ..... 105/282 R, 304, 253, 105/308 R, 282 A, 282 P

[56] References Cited

U.S. PATENT DOCUMENTS

| | | | |
|---|---|---|---|
| 3,712,249 | 1/1973 | Shaver | 105/282 R |
| 3,780,672 | 12/1973 | Fuller | 105/282 R |
| 3,938,861 | 2/1976 | Bagwell | 105/282 P |
| 4,094,254 | 6/1978 | Koranda | 105/282 P |
| 4,224,879 | 9/1980 | Van Auken | 105/282P |
| 4,256,042 | 3/1981 | Fischer | 105/282 P |

*Primary Examiner*—Richard A. Bertsch
*Attorney, Agent, or Firm*—F. Travers Burgess

[57] ABSTRACT

A hopper discharge unit for attachment to the bottom of a hopper has upright side and sloping end walls all terminating in horizontally inwardly directed flanges defining between them a rectangular outlet opening, with the side walls extended rearwardly beyond the sloping rear end wall to form a support for a sliding gate, which is perforated along its sides to form racks engaged by pinions on a transverse operating shaft journaled in the side wall extensions above the gate. To provide a tight seal the flange on the rear end wall is spaced above the side wall flanges to overlie the gate and a second longitudinal flange co-planar with the rear end wall flange is similarly spaced above the side wall flanges to overlie and cover the rack perforations in the gate when the gate is closed. Lugs on the front wall force the forward edge of the plate downwardly into sealing engagement with the flange on the front end wall when the gate is closed and a transverse rib on the top of the gate is adapted for wedging engagement with the rear of the rear end wall when the gate is fully closed. A gravity-actuated hook-like latch is arranged to lock the gate automatically when in closed position. For initiating opening movements of the gate, radial projections on the operating shaft engage the forward surfaces of upstanding blocks on the rear edge of the gate when opening movement of the shaft commences.

20 Claims, 15 Drawing Figures

HOPPER DISCHARGE UNIT WITH SLIDING GATE

BACKGROUND OF THE INVENTION

1. Field of the Invention

The invention relates to hopper discharge units of the rack and pinion actuated sliding gate type.

2. The Prior Art

The prior rack and pinion operated hopper gates, as exemplified in G. B. Dorey U.S. Pat. No. 3,106,899 have the rack formed on or attached to the bottom of the gate and the operating shaft and pinion are necessarily located below the gate. H. H. Pase U.S. Pat. No. 3,415,204 discloses the operating shaft above the gate plate, but with the racks formed on angle irons outboard of the side frames. The operating shaft capstans are frequenly formed with four bar-receiving holes positioned 90 degrees apart so that an operating bar can be inserted in only two positions, i.e., at right angles to each other.

SUMMARY OF THE INVENTION

The invention provides hopper discharge unit suitable for railway hopper cars, of greater simplicity resulting from fewer parts, reduced weight and increased clearance above the rail than conventional hopper gates.

It further provides a rack and pinion driven hopper discharge unit in which the actuating forces are applied more directly to the door plate and which has greater structural integrity than conventional structures, because of the formation of the rack teeth by spaced perforations in the door plate. The loss of a door plate due to structural damage or failure is less likely than in conventional hopper gate structures.

The invention also provides a break-away feature to increase the initial opening force of the pinion on the door plate to overcome resistance resulting from adhesive characteristics of certain types of loading.

It also provides a centrally located hopper gate lock and seal to make possible operation from either side of the car.

It provides a capstan configuration on the operating shaft which permits a greater choice of bar or lever positions for manual operation of the hopper gate.

It permits the lowest possible location of the door plate within the gate frame and thereby substantially reduces the likelihood of contamination during lading discharge.

DETAILED DESCRIPTION OF THE INVENTION

Figure 1:
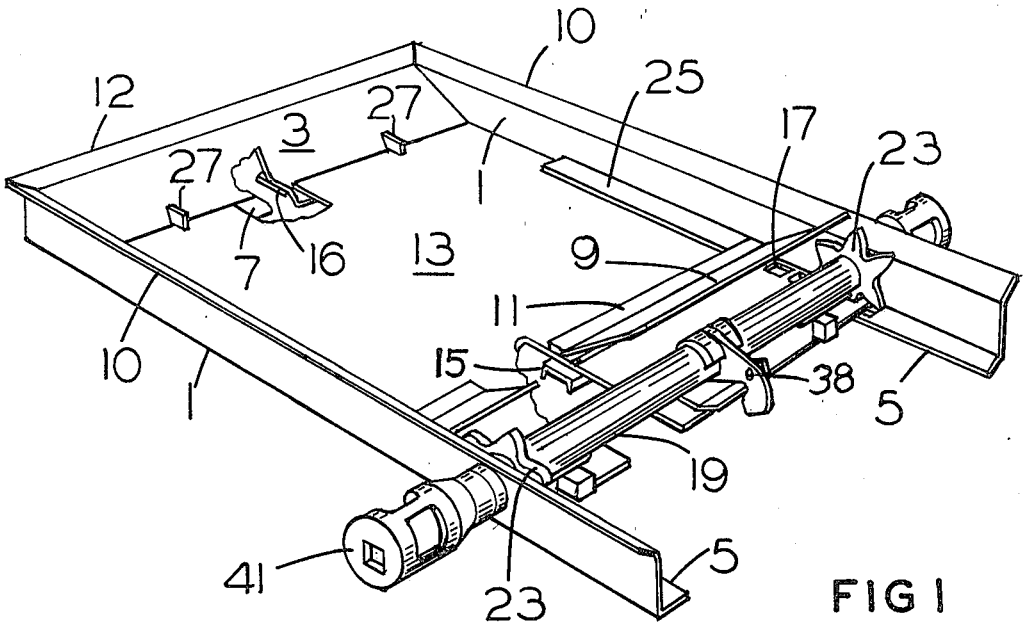
FIG. 1 is a perspective view of a hopper discharge unit constructed in accordance with the invention, with the gate in closed position.
Figure 2:
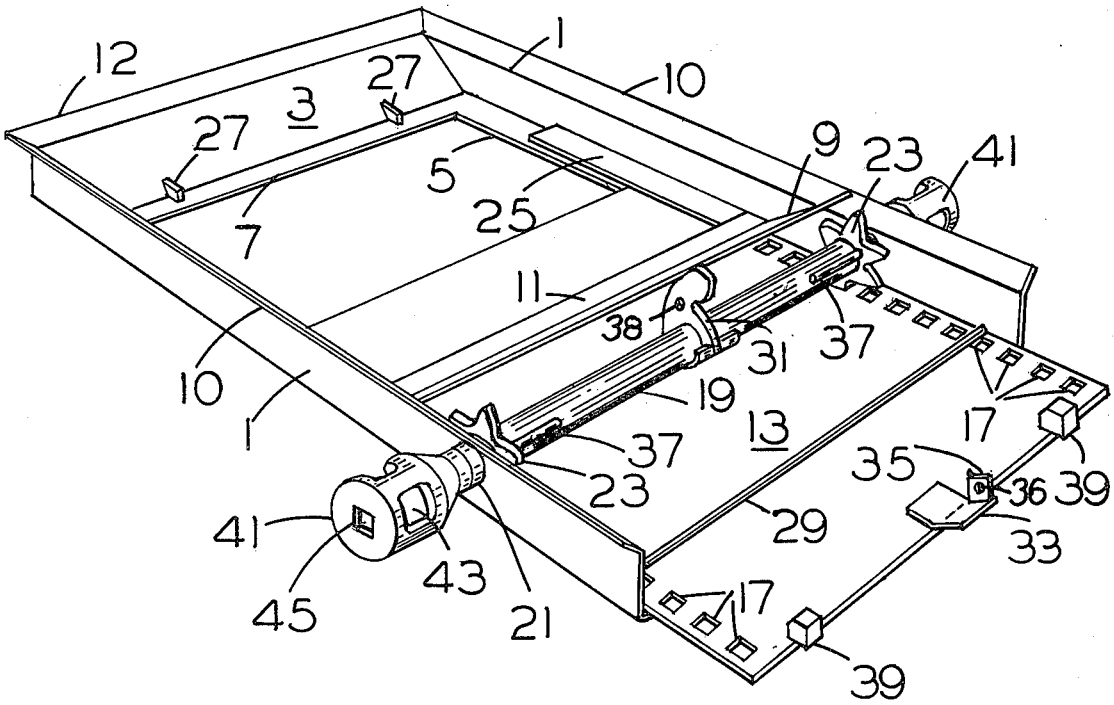
FIG. 2 is a perspective view similar to FIG. 1 but showing the gate in partially open position.
Figure 3:
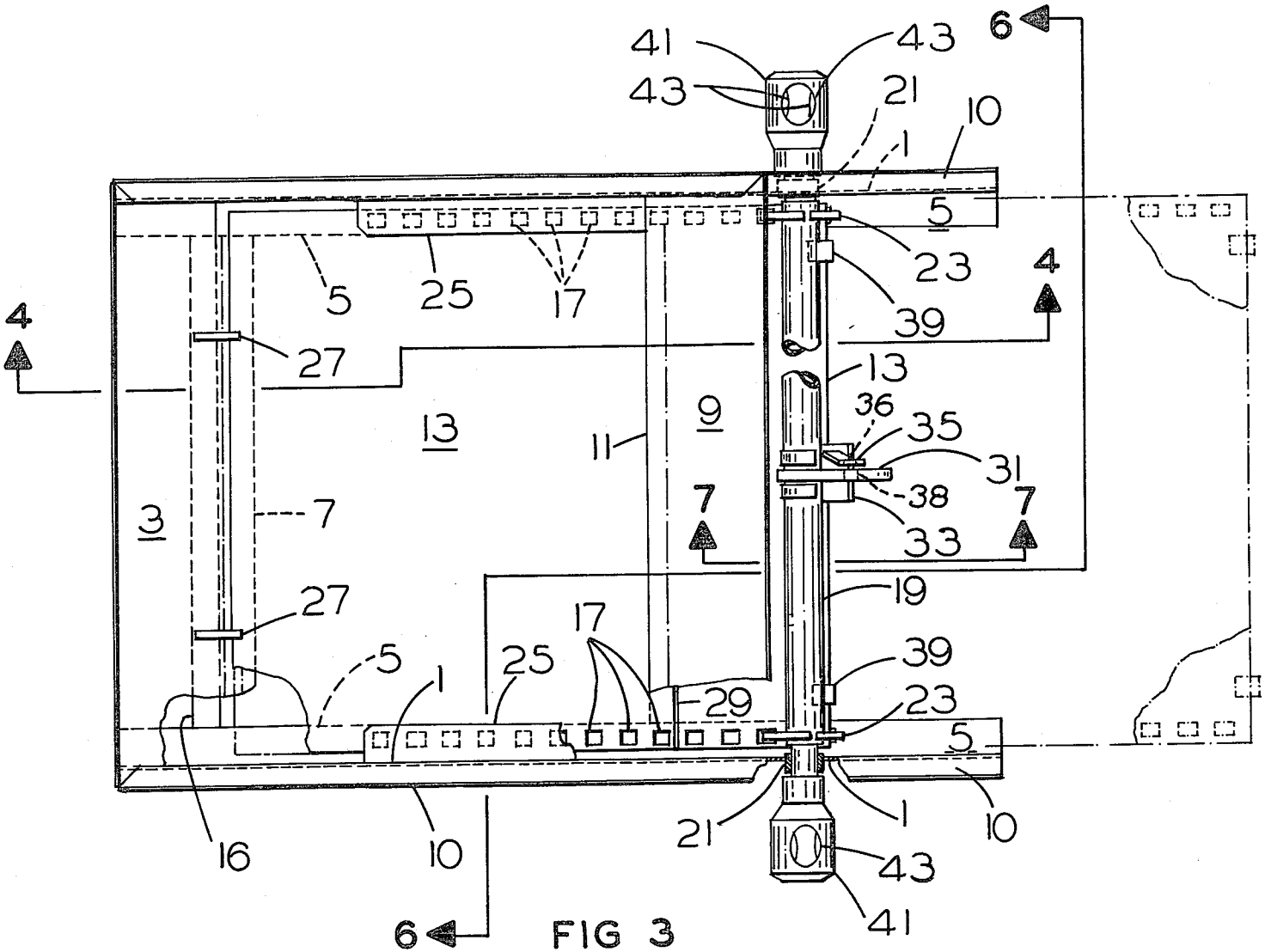
FIG. 3 is a plan view of the discharge unit illustrated in FIGS. 1 and 2 with the gate in closed position.
Figure 4:
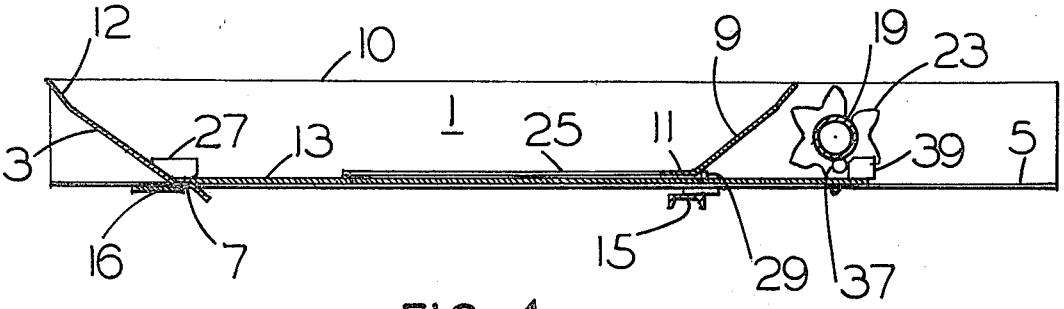
FIG. 4 is a longitudinal vertical sectional view of the unit taken along line 4—4 of FIG. 3.
Figure 5:
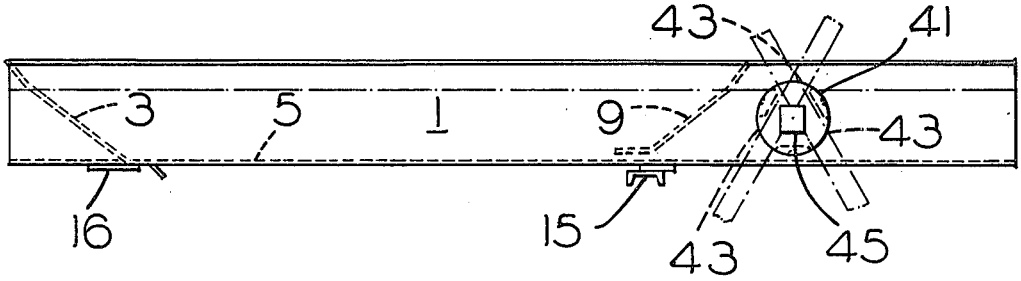
FIG. 5 is a side elevational view of the unit.
Figure 6:
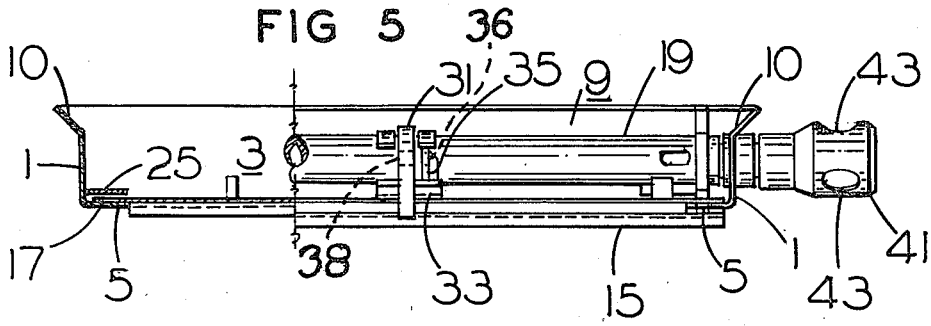
FIG. 6 is a transverse vertical sectional view of the unit taken along line 6—6 of FIG. 3.
Figure 8:
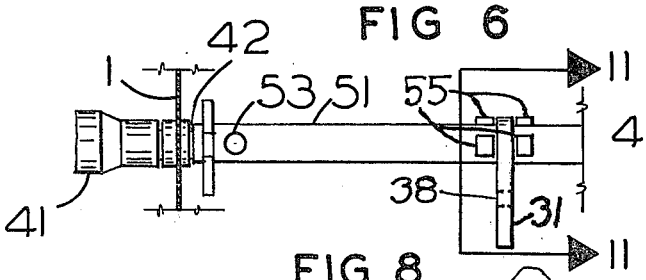
FIG. 8 is a fragmentary top view showing a modified form of operating shaft.
Figure 9:
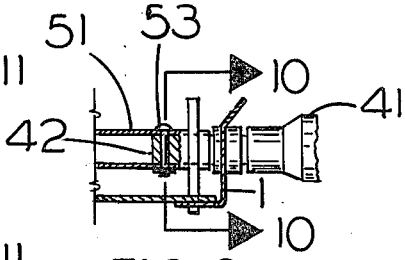
FIG. 9 is a fragmentary transverse vertical sectional view of the modified operatinng shaft.

The discharge unit has a pair of transversely spaced longitudinally extending upright side walls 1 and a sloping front end wall 3, all having inwardly directed coplanar horizontal flanges 5 and 7 respectively along their lower edges. Forwardly of the rear ends of side walls 1 they are intersected by a transverse rear wall 9 having along its lower margin a horizontal flange 11 spaced vertically upwardly from flanges 5 of side walls 1. Side walls 1 have outwardly directed sloping flanges 10 along their upper edges and the upper margins 12 of end walls 3 and 9 are arranged for securement to the bottom of a railroad car hopper.

A gate 13 comprising a rectangular plate rests slidably on flanges 5 of side walls 1 and underlies rear wall flange 11 for movement between the position shown in FIG. 1 in which it completely closes the discharge opening defined by front wall flange 7, side wall flanges 5 and rear wall flange 11 to a position in which the forward edge of the gate is aligned with the rear wall flange 11 to completely open the discharge opening.

To facilitate the attachment of a flexible boot to the unit during lading discharge, a pair of transverse members 15 and 16 are secured to the bottom of the unit respectively forwardly of the front edge of the discharge opening and rearwardly of the rear edge.

For moving the gate 13 between fully closed and fully open positions it is formed along each of its side margins with a series of uniformly spaced rectangular perforations 17, defining between them in the teeth of a rack, and an operating shaft 19 is journaled at 21 in the respective side walls 1, and mounts, immediately inwardly of the respective side walls, operating pinions 23 meshing with perforations 17 to move the gate 13 between open and closed positions responsive to rotation of shaft 19.

Because of the location of shaft 19 somewhat rearwardly of the rear wall 9, each series of perforations 17 is terminated near the edge of gate 13, leaving the forward marginal portions of the gate 13 imperforate. To provide a seal for preventing lading from entering into or passing through perforations 17 a pair of inwardly directed ribs or flanges 25, horizontal and co-planar with rear wall flange 11, overlie side wall flanges 5, being vertically spaced therefrom a sufficient distance to permit the sliding movement therebetween of the gate 13, while effectively shielding perforations 17 from the lading.

To hold the front end portion of gate 13 in tight sealing engagement with the underlying flanges 5 and 7, a pair of lugs 27 on the front wall are spaced vertically above the flange 7 thereof sufficiently to engage via their curved or beveled rear ends the front edge of the gate and urge the same downwardly into sealing engagement with flange 7; and to effect a tight seal between the rear edge of the opening and the gate, the gate is formed with an upstanding transverse rib 29 adapted for tight wedging engagement with the underside of the sloping rear wall 9 when the gate is fully closed.

For automatically locking the gate in closed position, a hook-like latch member 31 is formed with a circular hole by which it is rotatably mounted at the midpoint of the operating shaft 19, on which it is held against axial movement by a pair of semi-annular abutments 34 welded to shaft 19 on both sides of latch member 31. Latch member 31 is adapted to rotate clock-wise by gravity into engagement with the upper surface of the gate 13 and in longitudinal alignment therewith a tab 33 is secured to the rear margin of gate 13 and is bent slightly upwardly rearwardly thereof so that as the gate moves forwardly toward fully closed position, latch member 31 rides along the upper surface of gate 13 and over tab 33 and the hook engages the upwardly inclined projecting portion of tab 33 when the gate is fully closed, locking the gate in fully closed position. Tab 33 is formed with an upwardly facing flange 35 extending parallel to the locking member 31, and flange 35 and locking member 31 are both formed with aligned openings 36 and 38 to receive the conventional car seal when the gate is closed and locked.

For initiating opening movements of the gate, in the event the gate is stuck in closed position by some types of lading, such that the opening forces exerted by pinions 23 on racks 17 would be insufficient to overcome the stuck condition, a break-away mechanism comprises radial projections on the operating shaft 19 in the form of short rod sections 37 welded to operating shaft 19 adjacent pinions 23 and a pair of upstanding blocks 39 welded on top of the gate adjacent its rear edge and positioned thereon to engage projections 37 at a substantially smaller radius from the shaft axis than the point of engagement of pinions 23 and racks 17, when the gate is fully closed and to be pushed rearwardly by shaft projections 37 upon initial opening rotation of operating shaft 19. Because the break-away mechanism acts through a shorter arm than the pinions, it provides a greater mechanical advantage than the pinions and is capable of initiating opening movements where the pinions would be inadequate.

For manually rotating the shaft 19 between open and closed positions, at both of its ends it mounts hollow cylindrical capstans 41 each formed with three equiangularly spaced radial openings 43 for the insertion of bars or levers and a square aperture 45 in its flat end for insertion of a wrench. The provision of the three equiangularly spaced openings 43 permits the insertion of bars or levers at three different angular positions, as contrasted with the two different angular positions possible with four-hole capstans in common use.

Figure 10:
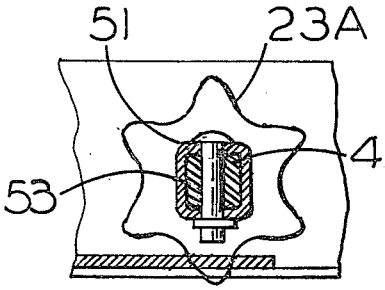
FIG. 10 is a fragmentary longitudinal vertical sectional view along line 10—10 of FIG. 9.
Figure 7:
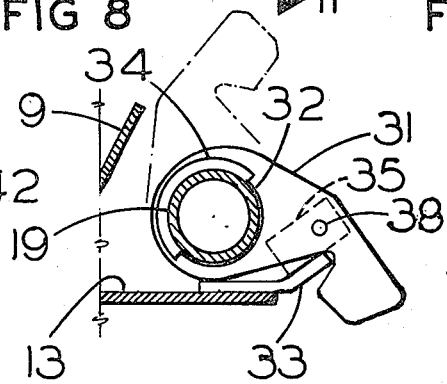
FIG. 7 is a fragmentary longitudinal vertical sectional view taken along line 7—7 of FIG. 3 showing the gate lock mechanism.
Figure 11:
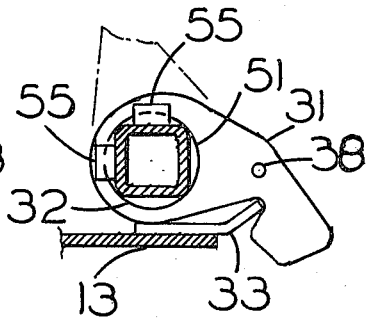
FIG. 11 is a fragmentary longitudinal vertical sectional view along line 11—11 of FIG. 8.

In the modified form of operating shaft illustrated in FIGS. 8–11, the shaft comprises a square tube 51, in the ends of which are received the square inner end portions 42 of capstans 41. Elongated fasteners such as rivets 53 passing through aligned diametral holes in tube 51 and capstan end portions 42 hold the tube and capstans in assembled condition. This method of assembly facilitates replacement of the tube or gate plate if they become bent or otherwise damaged, in that disassembly of the shaft for this purpose only requires removal of rivets 53. As best seen in FIG. 10, the square tube 51 provides a more positive mounting for the sprocket or pinion 23A which is formed with a corresponding square central hole. The central latch member 31 described previously may be utilized because its circular hole 32 permits its rotatable mounting on square tube 51. For holding latch member 31 against axial movement along tube 51, abutaent blocks 55 are welded to flat surfaces of the square tube adjacent opposite sides of plate 31.

Figure 12:
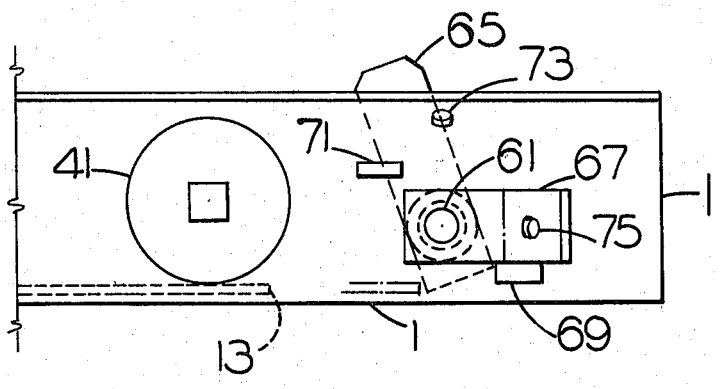
FIGS. 12 and 13 are fragmentary side elevational views showing a side lock mechanism respectively in released and locking positions.
Figure 13:
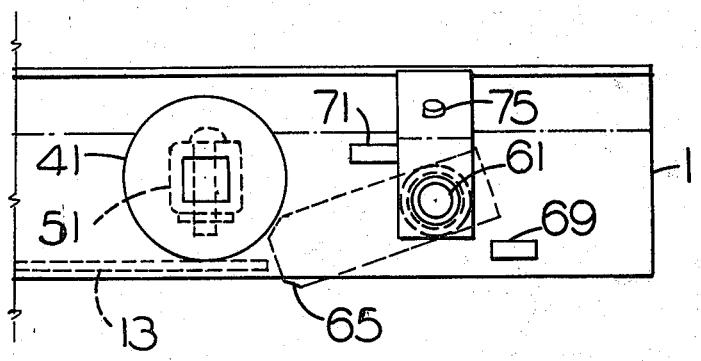
Figure 14:
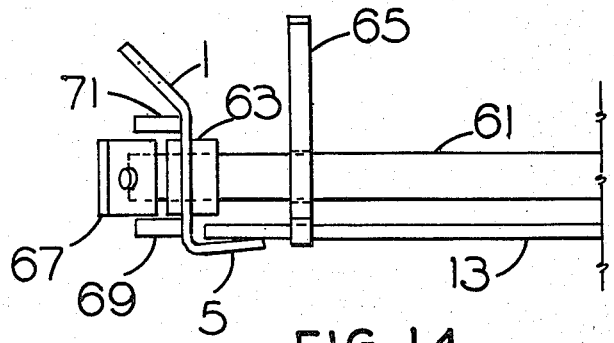
FIGS. 14 and 15 are fragmentary rear end elevational views corresponding to FIGS. 12 and 13 and showing the side lock mechanism respectively in released and locking positions.
Figure 15:
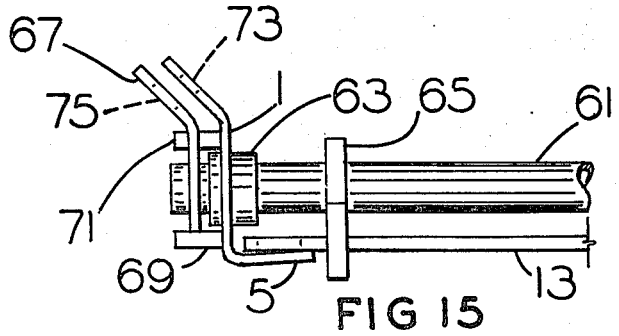

If desired, the side locks illustrated in FIGS. 12–15 may be applied to the unit instead of the center lock 31-36. The side lock comprises a lock shaft 61 journaled at 63 in both side walls 1 rearwardly of the operating shaft 51 and swingable between an unlocked nearly vertical position shown in FIG. 12 and forwardly extending, slightly below horizontal, locking position illustration in FIG. 13 in which the radially outer end of arm 65 blocks rearward opening movement of gate 13. For operating the lock shaft and applying the usual seal, each end of shaft 61 protrudes laterally outwardly from side wall 1 and mounts an operating arm 67 positioned on the shaft such that when locking arm 65 is in unlocking position as shown in FIGS. 12 and 14, operating arm 67 is horizontal and abuts lower stop abutment 69 on side wall 1, and when locking arm 65 is in locking position as shown in FIGS. 12 and 15, operating arm 67 is vertical and abuts upper stop abutment 71 on side wall 1. Side wall 1 and operating arm 67 are formed with holes 73 and 75 which are aligned when in locking position to receive the usual car seal. It will be noted that the lower end of locking arm 65, as seen in FIG. 12 projects downwardly below the upper surface of gate member 13, so that as the gate member moves rearwardly to full open position, its rear edge will engage the downwardly projecting end of arm 65, to cause arm 65 to rotate downwardly until it rests on gate member 13. Thus, when gate member 13 is closed, locking arm 65 will automatically drop into the locking position shown in FIG. 13.

The details of the hopper discharge unit disclosed herein may be varied substantially without departing from the spirit of the invention and the exclusive use of such modifications as come within the scope of the appended claims is contemplated.

I claim:

1. A hopper discharge unit having spaced side and front and rear walls defining a rectangular outlet opening, a rectangular gate member comprising a uniformly flat plate sidably mounted in said opening for movement from a closed position blocking said opening to an open position clear of said opening and having longitudinally aligned uniformly spaced perforations in its side margins forming toothed racks wholly co-planar with said flat plate, an operating shaft journaled in said side walls rearwardly of said opening above said gate member and having pinions mounted on its end portions adjacent to said side walls and meshing with said perforations to cause movement of said gate member between closed and open positions responsive to rotation of said shaft.

2. A hopper discharge unit according to claim 1 wherein said side walls and front end wall are formed with inwardly directed co-planar horizontal flanges, and said rear wall connects said side walls intermediate their ends and has a horizontal forwardly directed bottom flange spaced above and overlying the flanges of said side walls and with said front and side wall flanges forming the edges of said rectangular outlet opening, said gate member slidably resting on said side wall flanges forming the edges of said rectangular outlet opening, said gate member slidably resting on said side wall flanges and underlying said rear wall flange, said operating shaft being journaled in said side walls rearwardly of said rear wall, and second flanges on said side walls extending forwardly thereof from said rear wall flange in vertically spaced relation with said side wall first-named flanges and substantially co-planar with said rear wall flange and closely overlying said gate perforations when said gate is closed.

3. A hopper discharge unit according to claim 2 including means on said front wall overlyingly engageable with the front margin of said gate for urging the latter downwardly into tight sealing engagement with said front wall flange and means on said gate rearwardly of said rear wall engageable with said rear wall for forming a seal between said gate and said rear wall and urging the rear edge of said gate downwardly into tight engagement with said side wall flanges.

4. A hopper discharge unit according to claim 3, wherein said means on said front wall comprises a projection extending rearwardly therefrom for overlying abutting engagement with the top surface of said gate as said gate approaches fully closed position.

5. A hopper discharge unit according to claim 4, wherein said rear wall slopes upwardly and rearwardly from its bottom flange and said rear wall engageable means on said gate comprises a transverse rib on the upper surface of said gate wedgingly engageable with the rear surface of said rear wall when said gate is fully closed.

6. A hopper discharge unit according to claim 1, wherein said operating shaft has a radial projection closer to the axis of said shaft than the rack-engaging surface of said pinion and the rear portion of said gate has an upstanding lug abuttingly engageable with said radial projection when the gate is fully closed, whereby initial rotation of said operating shaft urges the gate rearwardly to initiate opening movement thereof.

7. A hopper discharge unit according to claim 1 including a hook-like latch member rotatably mounted on the operating shaft for gravitational movement about said shaft into engagement with the upper surface of said gate and means on the rear edge of said gate adapted to be hookingly engaged by said latch member when said gate is in fully closed position, and an upstanding element on said rear edge of the gate adjacent the engagement thereof by said latch member, said upstanding element and said latch member having aligned transverse holes for receipt of a car seal when the gate is fully closed.

8. A hopper discharge unit according to claim 7, wherein said latch member engaging means on the rear edge of said gate comprises an element having an upwardly and rearwardly sloping plate-like portion projecting rearwardly from said gate, said upstanding element comprising an upright tab on said sloping portion positioned for side by side relation with said latch member when said latch member engages the sloping portion.

9. A hopper discharge unit according to claim 1, including a capstan on an end of said shaft projecting laterally outwardly from a side wall, said capstan being formed with a central cavity and three equiangularly spaced radial openings communicating therewith to permit the insertion of operating bars in at least three different angular positions.

10. A hopper discharge unit according to claim 1, wherein said operating shaft has cylindrical end portions journaled in said side walls and a separate tubular intermediate portion positioned inwardly of said side walls and mounting said pinions, said intermediate portion removably receiving said end portions, and means securing said end portions to said intermediate portion to prevent relative rotation therebetween.

11. A hopper discharge unit according to claim 10, wherein said intermediate portion is of polygonal cross section.

12. A hopper discharge unit according to claim 11, wherein said intermediate portion is of square cross section.

13. A hopper discharge unit according to claim 12, wherein said securing means are elongated fasteners and said tubular member and the respective cylindrical end portions are formed with aligned diametral holes receiving said fasteners.

14. A hopper discharge unit according to claim 1, including a side lock mechanism comprising a locking shaft journaled in said side walls rearwardly of said operating shaft and mounting a radial locking arm arranged for rotation by said locking shaft between a downwardly inclined locking position blocking rearward movement of said gate member and an upwardly inclined unlocked position clear of said gate member.

15. A hopper discharge unit according to claim 14, including an operating arm fixed to said locking shaft outwardly of a side wall and selectively rotatable to move said shaft and locking arm between locked and unlocked positions.

16. A hopper discharge unit according to claim 15, including stops on said side wall adjacent said operating arm and engageable therewith to limit movements of said operating arm between locked and unlocked positions.

17. A hopper discharge unit according to claim 16, including holes in said side wall and said operating arm positioned for alignment when said operating arm is in locked position to receive a car seal.

18. A hopper discharge unit according to claim 16, wherein said radial locking arm has an oppositely directed radial portion engagement with the rear edge of said gate when said gate is partly open to cause said locking arm to rotate into engagement with the top of said gate and rest thereon, whereby to drop into locking position when said gate is closed.

19. In a hopper discharge unit having a frame defining an outlet opening, a gate slidable therein, and transverse shaft mounted on said frame rearwardly of said opening and above said gate and rotatable in respectively opposite directions to open and close said gate, a hook-like latch member rotatably mounted on said shaft and movable thereon in accordance with closing movements of said shaft into engagement with the upper surface of said gate as the gate approaches closed position, means on the rear edge of said gate adapted to be hookingly engaged by said latch member when said gate is in fully closed position, and an upstanding element on said rear edge of the gate adjacent the engagement thereof by said latch member, said upstanding element and said latch member having aligned transverse holes for receipt of a car seal when the gate is fully closed.

20. In a hopper discharge unit according to claim 19 said latch member engaging means on the rear edge of said gate comprising an element having an upwardly and rearwardly sloping plate-like portion projecting rearwardly from said gate, said upstanding element comprising an upright tab on said sloping portion positioned for side by side relation with said latch member when said latch member engages the sloping portion.

* * * * *